US007293327B2

(12) United States Patent
Tagliaferri

(10) Patent No.: US 7,293,327 B2
(45) Date of Patent: Nov. 13, 2007

(54) DEVICE FOR SUCTION OF WASTE AND SIMILAR

(75) Inventor: Fabrizio Tagliaferri, Trecasali (IT)

(73) Assignee: Dulevo International, S.p.A., Sanguinaro di Fontanellato (Parma) (IT)

( * ) Notice: Subject to any disclaimer, the term of this patent is extended or adjusted under 35 U.S.C. 154(b) by 0 days.

(21) Appl. No.: 11/543,444

(22) Filed: Oct. 5, 2006

(65) Prior Publication Data

US 2007/0079475 A1 Apr. 12, 2007

(30) Foreign Application Priority Data

Oct. 7, 2005 (EP) ..... 05425701

(51) Int. Cl.
*A47I 9/02* (2006.01)

(52) U.S. Cl. ..... 15/415.1; 15/340; 15/354; 15/422

(58) Field of Classification Search ..... None
See application file for complete search history.

(56) References Cited

U.S. PATENT DOCUMENTS

| | | | | |
|---|---|---|---|---|
| 3,445,879 | A | 5/1969 | Taylor | |
| 4,868,948 | A | 9/1989 | Arnold et al. | |
| 6,584,640 | B2 * | 7/2003 | Vanderlinden | 15/418 |

FOREIGN PATENT DOCUMENTS

| | | |
|---|---|---|
| CA | 2 357 057 A1 | 2/2003 |
| EP | 0 114 114 A1 | 7/1969 |

* cited by examiner

*Primary Examiner*—David Redding

(57) ABSTRACT

The invention relates a device for suction of waste and similar, in a machine for cleaning roads and similar comprising a suction pipe (2), an inlet aperture (3) of the suction pipe (2), and a sweeper device (4) of the pipe (2) positioned near the inlet aperture (3) and suitable to free the suction pipe (2) of any impediments.

5 Claims, 1 Drawing Sheet

DEVICE FOR SUCTION OF WASTE AND SIMILAR

The present invention relates a device for suction of waste and similar of the type specified in the preamble of the first claim.

Machines for cleaning roads, squares and similar that suck waste from the ground and store it in an internal container are currently known.

Said machines use a complex suction system which has an inlet positioned near the ground.

The inlet is therefore the first portion of the cleaning machine through which the waste passes, and is furthermore the portion of the cleaning machine nearest the ground that has to be swept or cleaned.

A fundamental part of the inlet is the aperture of the suction pipe, through which the waste and other substances are sucked.

Any clogging of the inlet or of said aperture makes the sweeping machine totally unserviceable.

A drawback of the known technique is the fact that the inlet is often clogged by waste which is too bulky.

Said waste can easily jam in the suction inlet, in particular in the part near the aperture of the pipe.

Consequently it is necessary to interrupt operation of the sweeping machine and manually disengage the suction pipe by means of pincers or other tools.

Said operation is labour-intensive and entails machine standstill.

The problem can be partially solved by increasing the diameter of the suction pipe and the aperture of the pipe itself.

However, the above solution requires re-design of the whole suction system and in particular increase in power of the same, furthermore it does not provide a remedy against clogging due to the suction of branches, twigs and other particularly large items of waste.

In this situation the technical task at the basis of the present invention is to conceive a device for suction of waste and similar able to substantially solve the drawbacks referred to.

Within said technical task an important aim of the invention is to produce a device that cannot be obstructed by waste, even if bulky such as branches and similar, and is also easily and quickly repairable in the event of obstruction.

The technical task is achieved by a device for suction of waste and similar as claimed in the attached claim 1.

Preferred embodiments are highlighted in the sub-claims.

Figure 1:
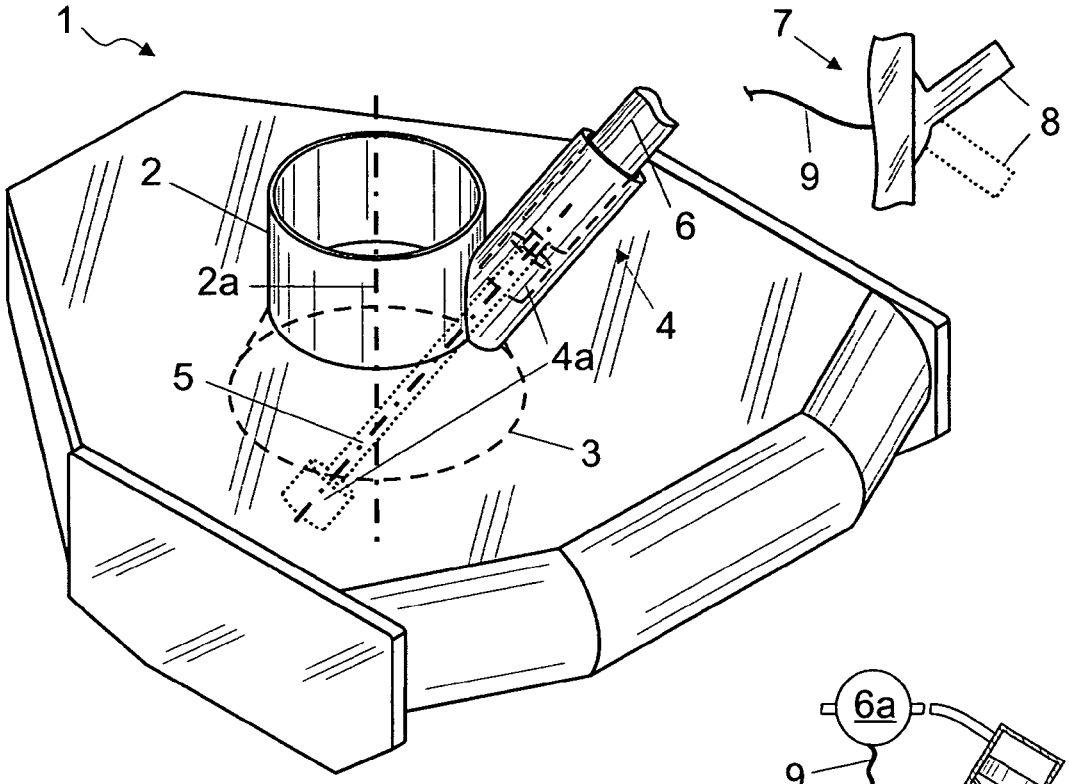
Figure 2:
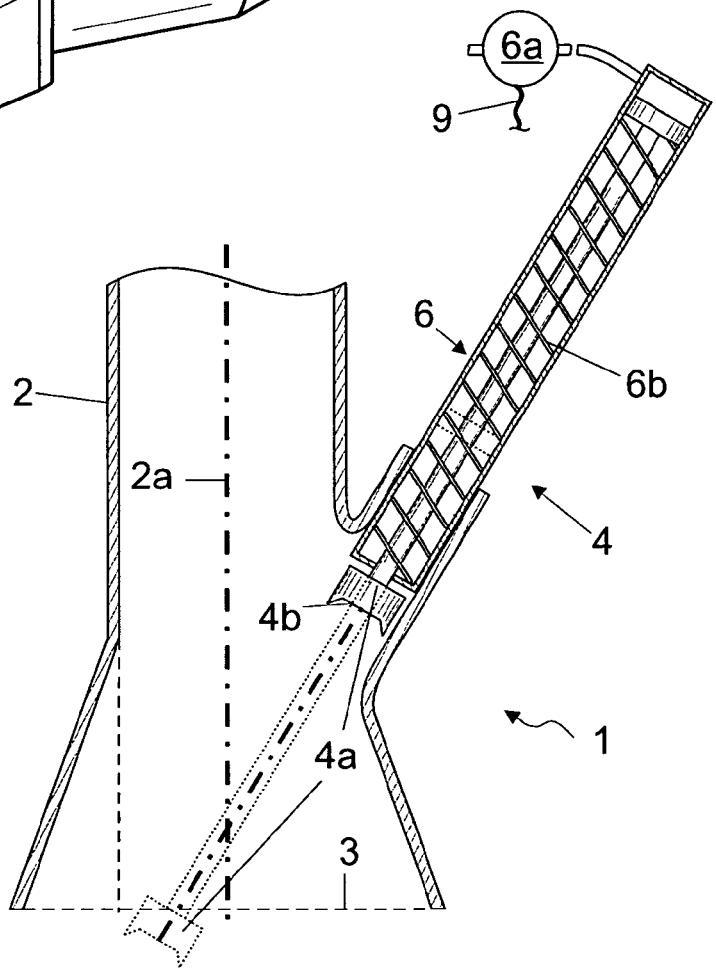

Further characteristics and advantages of the invention are better clarified by the following detailed description of a preferred embodiment of the invention, with reference to the attached drawings, in which:

FIG. 1 shows a figure illustrating the device according to the invention axonometrically; and FIG. 2 illustrates the device according to the invention in section.

With reference to the above Figures, the device according to the invention is indicated overall by the number 1.

It is used on machines for cleaning roads and similar which comprise a waste suction system.

Said suction system necessarily comprises a suction pipe 2 which conveys the waste inside the sweeping machine into a container provided for the purpose.

The suction pipe 2 communicates with the outside via an inlet aperture 3 and advantageously comprises a sweeper device 4 of the pipe 2, positioned near the inlet aperture 3.

Said sweeper device 4 is designed to free the suction pipe 2 of any impediments.

For said purpose the sweeper device 4 appropriately consists of a piston 4*a* having a forward trajectory 5 that interferes with the suction pipe 2. The forward trajectory 5 is preferably slanting in space with respect to the axis 2*a* of the suction pipe 2 and intersects said axis 2*a*. It therefore crosses the whole area of the pipe 2 near the aperture 3 and ensures interception of any element positioned there.

The forward movement of the piston 4*a* is then directed towards the inlet aperture 3 and appropriately crosses said aperture 3, going beyond it.

When in the rest position, the piston 4*a* remains outside the suction pipe 2, in order not to reduce the section of the same and not to constitute any impediment to crossing of the waste. It furthermore has, advantageously, a head with concave operating surface 4*b* designed to intercept any waste rather than wedging into it.

The piston 4*a* is furthermore preferably moved by a fluid dynamic cylinder 6, more preferably by a hydraulic cylinder, for example of the single-acting type.

It is driven by means of a pump 6*a* which acts against an elastic element 6*b*.

The fluid dynamic cylinder 6 is also positioned externally to the pipe 2 and does not interfere with the same.

The device 1 furthermore comprises a control system 7 of the sweeper device 4.

Said control system 7 appropriately consists of a control member 8 and transmissions 9, appropriately of electric type, which connect said control member 8 to the pump 6*a* which drives the fluid dynamic cylinder 6.

The control member 8 is preferably positioned near the controls of said cleaning machine, so that it is very simple and quick to operate.

The operation of a suction device according to the invention, structurally described above, is the following.

When the cleaning machine is active, the suction system sucks in waste and similar via the suction pipe 2.

The waste passes through the aperture 3, is sucked into the pipe and from here is usually deposited in a container inside the cleaning machine.

During passage of the waste the piston 4*a* does not hinder or obstruct the pipe 2, since it is outside the same and is kept in said position by the elastic element 6*b*.

As already specified, particularly bulky waste, for example branches, often jams in the suction pipe 2 during operation of the cleaning machine.

Said waste obstructs the suction pipe 2 at or near the aperture 3, where the sweeper device 4 is positioned.

In the event of a problem of the above type, the operator who notices can simply operate the sweeper device 4 via the control member 8.

In particular the pump 6*a* is operated which moves the fluid dynamic cylinder 6 counter to the elastic element 6*b*. The piston 4*a* then pushes said waste towards the aperture 3 and expels it from the suction pipe 2 via the aperture 3.

The sweeper device 4 then frees the aperture 3 from the jammed waste.

At the end of the operation the pump 6*a* interrupts the action on the fluid dynamic cylinder 6 which is re-positioned outside the suction pipe 2 by the elastic element 6*b*.

The invention offers important advantages.

The device 1, by means of the sweeper device 4, allows the suction pipe 2 to be freed rapidly and without interrupting operation, therefore restoring full operation of the cleaning machine.

The control member 8 is furthermore positioned near the controls of the cleaning machine, hence it is quick and simple to operate and this results in less waste of time and more rapid cleaning of the road or similar.

The device 4, if constituted by the piston 4*a*, is furthermore structurally very simple, linear and sturdy, therefore malfunctions and similar occur very rarely.

Lastly it does not constitute impediments to the suction pipe 2 when at rest.

What I claim is:

1. Device for suction of waste and similar, in a cleaning machine comprising a suction system comprising a suction pipe (2) defining an axis (2*a*) and an inlet aperture (3) of said suction pipe (2), said device comprising a sweeper device (4) of said pipe (2) near said inlet aperture (3) suitable to expel impediments from said suction pipe (2), said sweeper device (4) comprising a piston (4*a*) having a forward trajectory (5) completely crossing the internal diameter of the pipe and interfering with said suction pipe (2), and slanting in space with respect to said axis (2*a*), and in which said piston (4*a*) moves between a rest position outside said suction pipe (2) and an advanced position in said suction pipe (2) at said inlet aperture (3).

2. Suction device according to claim 1, wherein said piston (4*a*) is driven by a fluid dynamic cylinder (6).

3. Suction device according to claim 2, wherein said fluid dynamic cylinder (6) is a hydraulic cylinder.

4. Suction device according to claim 1, wherein said piston (4*a*) has a concave operating surface (4*b*).

5. Suction device according to claim 1, wherein said sweeper device (4) is driven by a control member (8), and said cleaning machine is driven by means of controls, and wherein said control member (4) is near said controls of said cleaning machine.

* * * * *